US009278802B2

(12) United States Patent
Huang et al.

(10) Patent No.: US 9,278,802 B2
(45) Date of Patent: Mar. 8, 2016

(54) DETACHABLE CONTAINER

(75) Inventors: Tianhua Huang, Shandong (CN); Xiaoyi Wang, Shandong (CN); Renyong Xu, Shandong (CN); Duanjun Ma, Shandong (CN); Zhengguo Gao, Shandong (CN); Xuri Gao, Shandong (CN); Dongfeng Zhao, Shandong (CN)

(73) Assignees: CIMC VEHICLES (GROUP) CO., LTD., Shenzhen, Guangdong (CN); QINGDAO CIMC REEFER TRAILER CO., LTD., Jiaozhou Qingdao, Shandong (CN); CHINA INTERNATIONAL MARINE CONTAINERS (GROUP) LTD., Shenzhen, Guangdong (CN)

( * ) Notice: Subject to any disclaimer, the term of this patent is extended or adjusted under 35 U.S.C. 154(b) by 0 days.

(21) Appl. No.: 14/367,077

(22) PCT Filed: Aug. 20, 2012

(86) PCT No.: PCT/CN2012/080342

§ 371 (c)(1),
(2), (4) Date: Jun. 19, 2014

(87) PCT Pub. No.: WO2013/097469

PCT Pub. Date: Jul. 4, 2013

(65) Prior Publication Data

US 2014/0326719 A1 Nov. 6, 2014

(30) Foreign Application Priority Data

Dec. 26, 2011 (CN) ..... 2011 2 0550684 U

(51) Int. Cl.
*B65D 88/52* (2006.01)
*B65D 6/16* (2006.01)
(Continued)

(52) U.S. Cl.
CPC ..... *B65D 88/528* (2013.01); *B65D 7/24* (2013.01); *B65D 9/12* (2013.01); *B65D 11/1873* (2013.01);
(Continued)

(58) Field of Classification Search
CPC ..... B65D 88/528; B65D 90/08; B65D 19/06; B65D 7/24; B65D 9/12; B65D 11/1873; B65D 2519/00661; B65D 2519/00606; B65D 2519/00711
USPC ..... 220/4.29, 4.31, 4.32, 4.33, 4.34, 6, 4.28
See application file for complete search history.

(56) References Cited

U.S. PATENT DOCUMENTS

| | | | | |
|---|---|---|---|---|
| 7,267,229 | B2 * | 9/2007 | Chen | B65D 19/06 206/386 |
| 2009/0218341 | A1 * | 9/2009 | Wu | 220/4.28 |
| 2009/0261093 | A1 * | 10/2009 | Fullerton et al. | 220/4.28 |

FOREIGN PATENT DOCUMENTS

| | | |
|---|---|---|
| CN | 2595688 Y | 12/2003 |
| CN | 2820717 Y | 9/2006 |

(Continued)

*Primary Examiner* — Robert J Hicks
*Assistant Examiner* — Kareen Thomas
(74) *Attorney, Agent, or Firm* — Harness, Dickey & Pierce, P.L.C.; Stephen T. Olson

(57) ABSTRACT

The present invention discloses a detachable container comprising a base, side panels, corner posts and a roof panel, wherein the side panels are detachably connected to the base and to the roof panel, the corner posts are located between adjacent side panels and the side panels are detachably connected to the corner posts, respectively. A connection is employed for connecting the side panels with the base, the corner posts and the roof panel of the detachable container according to the present invention. Therefore, in the process of returning empty containers, each of the containers can be detached and form a whole piece, so as to reduce the space occupied. In addition, a modularized design may be employed for each component of the detachable container, so as to achieve universality of components of the container. Furthermore, this detachable container also has the advantages of convenient assembly, simple structure, etc.

12 Claims, 5 Drawing Sheets

(51) Int. Cl.

| | |
|---|---|
| ***B65D 19/06*** | (2006.01) |
| ***B65D 90/08*** | (2006.01) |
| ***B65D 6/24*** | (2006.01) |

(52) U.S. Cl.

CPC ..... *B65D 19/06* (2013.01); *B65D 90/08* (2013.01); *B65D 2519/00606* (2013.01); *B65D 2519/00661* (2013.01); *B65D 2519/00711* (2013.01)

(56) References Cited

FOREIGN PATENT DOCUMENTS

| | | | |
|---|---|---|---|
| CN | 201201741 | Y | 3/2009 |
| CN | 201439431 | U | 4/2010 |
| CN | 202368862 | U | 8/2012 |
| JP | 2001-072057 | A | 3/2001 |

* cited by examiner

DETACHABLE CONTAINER

CROSS-REFERENCE TO RELATED APPLICATIONS

This application is a U.S. National Stage Application of International Application No. PCT/CN2012/080342 filed on Aug. 20, 2012, and published in Chinese as WO 2013/097469 A1 on Jul. 4, 2013. This application claims priority to Chinese Application No. 201120550684.4 filed on Dec. 26, 2011. The entire disclosures of the above applications are incorporated herein by reference.

FIELD OF INVENTION

The present invention relates generally to the container transportation field and, in particular, to a detachable container.

BACKGROUND

Containers for use in transportation generally have an integrated welded structure or a non-detachable bolted structure. Since these containers cannot be fast and conveniently detached in the process of being returned empty, whole containers usually have to be placed on the transport vehicles. These empty containers in transportation occupy a relatively large space, thus leading to relatively low transportation efficiency and comparatively high transportation cost.

Therefore, the provision of a detachable container is required to solve the abovementioned problems.

SUMMARY OF THE INVENTION

A series of concepts in simplified forms will be introduced in this section of Summary of the Invention, and will be further explained in detail in the section of Detailed Description. The Summary of the Invention is not intended to define the key features and essential technical features of the technical solutions claimed for protection, and neither is it intended to define the scope of protection of the technical solutions claimed for protection.

For the purpose of solving the abovementioned problems, the present invention discloses a detachable container comprising a base, side panels, corner posts and a roof panel, wherein the side panels are detachably connected to the base and to the roof panel, the corner posts are located between adjacent side panels and the side panels are detachably connected to the corner posts, respectively.

Preferably, the roof panel comprises a roof plate and a skirt, with the skirt being arranged around the periphery of the roof plate and extending downwards, so as to form a cavity in the roof panel.

Preferably, the dimensions of the side panels are smaller than that of the roof panel such that they can be accommodated within the cavity in a detached state.

Preferably, the cross section of each of the corner posts is L-shaped, with the two edges of the L shape being connected to adjacent side panels, respectively.

Preferably, the detachable container further comprises a base connector, a roof panel connector and a side panel connector, with the base connector connecting the side panels detachably to the base, the roof panel connector connecting the side panels detachably to the roof panel, and the side panel connector connecting the side panels detachably to the corner posts.

Preferably, the base connector comprises a base groove located at each edge of the base, a lower-side-panel groove located at a lower edge of an inner side of each of the side panels, a connection plate between the base and the side panels, a base connection member, and a lower-side-panel connection member, wherein one end of the base connection member is disposed within the base groove, and one end of the lower-side-panel connection member is disposed within the lower-side-panel groove, and wherein the side panels are detachably connected to the base by connecting the other ends of the base connection member and the lower-side-panel connection member to the connection plate between the base and the side panels, respectively.

Preferably, the base groove extends along each edge of the base, the one end of the base connection member is slidably disposed within the base groove along an extending direction of the base groove, the lower-side-panel groove extends along the lower edge of the inner side of each of the side panels, and the one end of the lower-side-panel connection member is slidably disposed within the lower-side-panel groove along an extending direction of the lower-side-panel groove.

Preferably, the cross section of the connection plate between the base and the side panels is L-shaped, with the two edges of the L shape being connected to the base and the side panels, respectively.

Preferably, the roof panel connector comprises a roof panel groove located on each edge of the roof panel, an upper-side-panel groove located on an upper edge of an inner side of each of the side panels, a connection plate between the roof panel and the side panels, a roof panel connection member, and an upper-side-panel connection member, wherein one end of the roof panel connection member is disposed within the roof panel groove, and one end of the upper-side-panel connection member is disposed within the upper-side-panel groove, and wherein the side panels are detachably connected to the roof panel by connecting the other ends of the roof panel connection member and the upper-side-panel connection member to the connection plate between the roof panel and the side panels, respectively.

Preferably, the roof panel groove extends along each edge of the roof panel, the one end of the roof panel connection member is slidably disposed within the roof panel groove along an extending direction of the roof panel groove, the upper-side-panel groove extends along the upper edge of the inner side of each of the side panels, and the one end of the upper-side-panel connection member is slidably disposed within the upper-side-panel groove along an extending direction of the upper-side-panel groove.

Preferably, the roof panel comprises a roof plate and a skirt, with the skirt being arranged around the periphery of the roof plate and extending downwards, the roof panel groove is located on the skirt, and the connection plate between the roof panel and the side panels is in the shape of a flat panel, with two ends of the flat panel being connected to the skirt and the side panels, respectively.

Preferably, the side panel connector comprises a side panel groove located at a side edge of an inner side of each of the side panels, a corner post groove located at an inner side of each of the corner posts, a connection plate between the corner posts and the side panels, a side panel connection member, and a corner post connection member, wherein, one end of the side panel connection member is disposed within the side panel groove, and one end of the corner-post connection member is disposed within the corner post groove, and wherein the side panels are detachably connected to the corner posts by connecting the other ends of the side panel connection member and the corner post connection member to the connection plate between the corner posts and the side panels, respectively.

Preferably, the side panel groove extends along the side edge of the inner side of each of the side panels, the one end of the side panel connection member is slidably disposed within the side panel groove along an extending direction of the side panel groove, the corner post groove extends along the inner side of each of the corner posts, and the one end of the corner post connection member is slidably disposed within the corner post groove along an extending direction of the corner-post groove.

Preferably, the connection plate between the corner posts and the side panels is in the shape of a flat panel, with two ends of the flat panel being connected to the corner posts and the side panels, respectively.

As described above, a detachable connection is employed for connecting the side panels with the base, the corner posts and the roof panel of the detachable container according to the present invention. Therefore, in the process of returning empty containers, each of the containers can be detached and form a whole piece, so as to reduce the space occupied. In addition, a modularized design may be employed for each component of the detachable container, so as to achieve universality of components of the container. Furthermore, this detachable container also has the advantages of convenient assembly, simple structure, etc.

BRIEF DESCRIPTION OF THE DRAWINGS

The accompanying drawings of the present invention are incorporated herein as a part of the specification to facilitate understanding of the present invention. The accompanying drawings illustrate embodiments of the present invention and, together with the description, serve to explain the principles of the present invention. In the drawings.

DETAILED DESCRIPTION

Great specific details will be provided in the following description to facilitate more thorough understanding of the present invention. However, it would be apparent to those skilled in the art that the present invention can be embodied without requiring one or more of these details. In other examples, some technical features well-known in the art will not be described, in order to avoid causing confusion with the present invention.

For the purpose of thorough understanding of the present invention, detailed structures will be provided in the following description. Evidently, implementation of the present invention is not limited to particular details familiar to those skilled in the art. Detailed descriptions of preferred embodiments of the present invention will be provided as follows. However, besides these detailed descriptions, there may be other embodiments of the present invention.

Figure 1A:
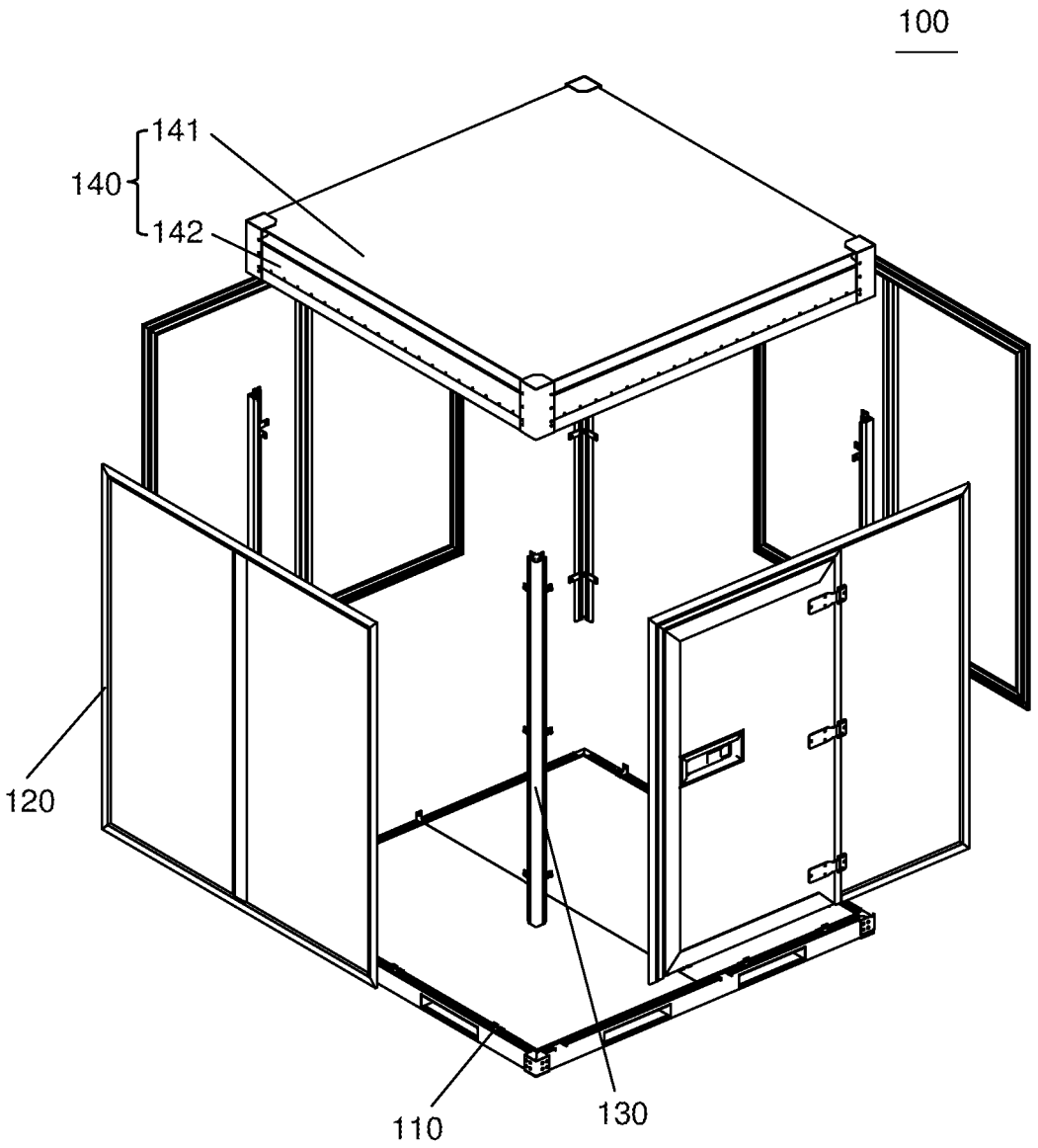
FIG. 1A illustrates an exploded view of a detachable container according to an embodiment of the present invention.
Figure 1B:
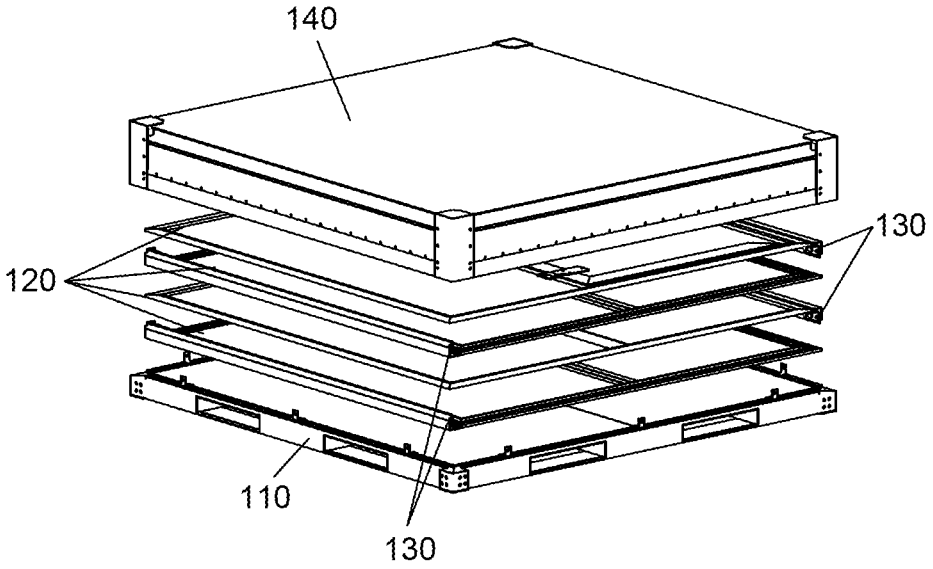
FIG. 1B illustrates a schematic view of a detachable container in a folding process according to an embodiment of the present invention.
Figure 1C:
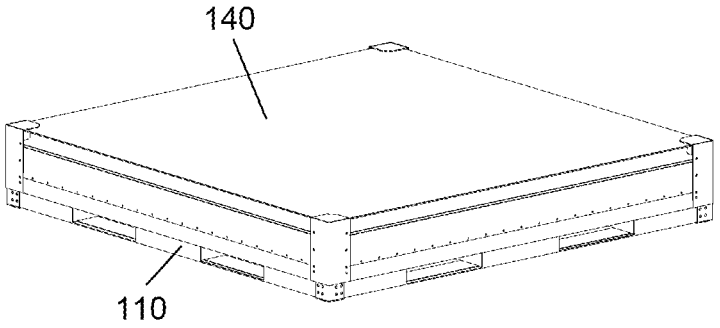
FIG. 1C illustrates a schematic view of a detachable container after being folded up according to an embodiment of the present invention.

FIG. 1A illustrates an exploded view of a detachable container according to an embodiment of the present invention, FIG. 1B is a schematic view of a detachable container in a folding process according to an embodiment of the present invention, and FIG. 1C is a schematic view of a detachable container after being folded up according to an embodiment of the present invention. A detailed description of this detachable container will be provided as follows by referring to FIGS. 1A-1C.

A detachable container 100 comprises a base 110, side panels 120, corner posts 130 and a roof panel 140. The base 110 is used to support the cargo placed within the detachable container 100, and therefore, it needs to possess enough strength. The side panels 120 are detachably connected to the base 110 and to the roof panel 140 to form a space for accommodating cargo. In addition, the corner posts 130 are arranged between adjacent side panels 120, that is, the corner posts 130 are vertically arranged around the corner of the side walls of the detachable container 100 to connect adjacent side panels 120. Each of the side panels 120 is detachably connected to the corner posts 130. Wherein, a detachable connection, such as socket connection, threaded connection, clamping, etc., can be employed for connection between the side panels 120 and the base 110, between the side panels 120 and the roof panel 140, as well as between the side panels 120 and the corner posts 130. Also, an assisting connection device may be employed to achieve detachable connection. The present application will provide a preferable detachable connection which will be described in detail later in this disclosure. Because of the employment of the detachable connection between the side panels 120 and the base 110, the corner posts 130 and the roof panel 140, in the process of returning empty containers, these containers can be detached and folded into a whole piece, so as to reduce the occupation space.

According to an embodiment of the present invention, the roof panel 140 comprises a roof plate 141 and a skirt 142. The roof panel 141 can be of a plate-like structure or other similar structure, for covering onto the side panels 120 to form a relatively closed space for containing cargo. The skirt 142 is arranged around the periphery of the roof plate 141 and extends downwards, so as to form a cavity (not indicated) in the roof panel 140. This cavity is located under the roof plate 141 and surrounded by the skirt 142, for accommodating components including the side panels 120 and the corner posts 130 within this cavity after the detachable container 100 is detached. Furthermore, the dimensions of the side panels 120 are smaller than that of the roof panel 140 such that they can be accommodated within this cavity in a detached state. Since the dimensions of the side panels 120 are smaller than that of the roof panel 140 and a space for accommodating the side panels 120 is formed in the roof panel 140, in a detached state, the base 110 and the roof panel 140 can be used to pack the side panels 120 and the corner posts 130 therein (as shown in FIGS. 1B and 1C). The integrating of the detached components in a whole piece with a regular shape not only can avoid loss of detached components, but also can make the carrying and stacking of detached containers more convenient. As the dimensions of the side panels 120 are smaller than that of the roof panel 140, in order to ensure the enclosure of the detachable container 100, preferably, the cross section of each of the corner posts 130 is L-shaped, and the two edges of the L shape are connected to adjacent side panels 120, respectively.

In consideration of such factors as transportation efficiency and detaching convenience, the present invention provides a connector that can be detached fast, for connecting the side panels 120 and the base 110, the side panels 120 and the roof panel 140, as well as the side panels 120 and the corner posts 130. The detachable container 100 further comprises a base connector, a roof panel connector and a side panel connector, wherein the base connector connects the side panels 120 detachably to the base 110, the roof panel connector connects the side panels 120 detachably to the roof panel 140, and the side panel connector connects the side panels 120 detachably to the corner posts 130. A detailed description of these connectors will be provided as follows by referring to FIGS. 2A-2B, 3A-3B and 4A-4B. It should be noted that the structures of the connectors to be described in the following are only one preferred mode of implementation of the present invention, and thus, it shall not be understood as constituting any limit of the present invention.

Figure 2A:
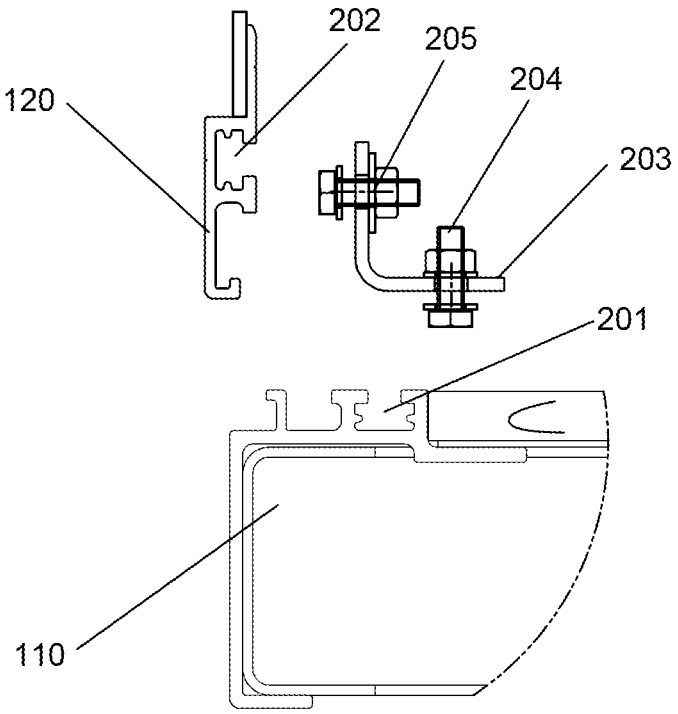
FIGS. 2A and 2B illustrate an exploded view of side panels and a base and a schematic view of side panels and a base after assembly, respectively according to an embodiment of the present invention.
Figure 2B:
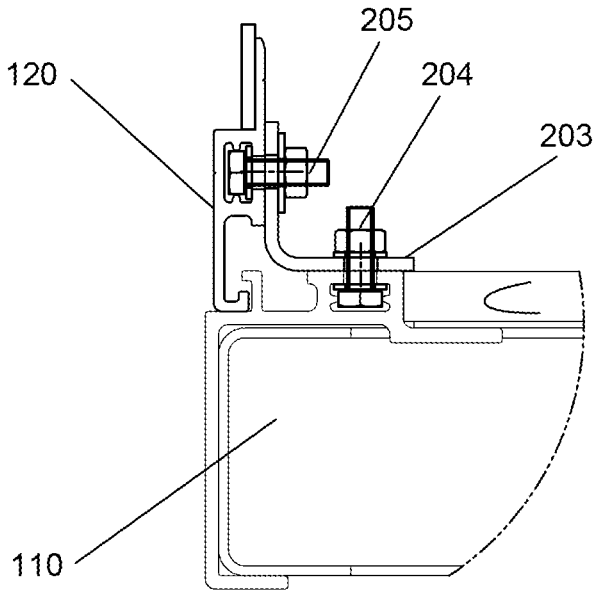

As shown in FIGS. 2A-2B, the base connector comprises a base groove 201, a lower-side-panel groove 202, a connection plate 203 between the base and the side panels (hereinafter referred to as the connection plate 203 for short), a base connection member 204 and a lower-side-panel connection member 205.

The base groove 201 is located at an edge of the base 110, so as for the connection between the base 110 and the connection plate 203, and one end of the base connection member 204 is disposed within the base groove 201. The lower-side-panel groove 202 is located at a lower edge of an inner side of a side panel 120, for the connection between the side panel 120 and the connection plate 203, and one end of the lower-side-panel connection member 205 is disposed within the lower-side-panel groove 202. Since the base groove 201 and the lower-side-panel groove 202 are both located inside, the outer surface of the container has no fastener protruding outwards and exposed such that the outer surface of the container is smooth and pleasant-looking. As can be understood, base grooves 201 can be arranged at edges of the base 110 to be connected to the side panels 120, and accordingly, lower-side-panel grooves 202 can be arranged at lower edges of inner sides of the side panels 120. And, the base groove 201 and the lower-side-panel groove 202 may be in any shape and of any structure, as long as they can accommodate one end of the base connection member 204 and one end of the lower-side-panel connection member 205, respectively. In addition, one or more connectors may be arranged at the lower edge of the inner side of each of the side panels 120 and at the corresponding position at each edge of the base 110 as needed.

The other end of the base connection member 204 and the other end of the lower-side-panel connection member 205 are respectively connected to the connection plate 203. By connecting the other end of the base connection member 204 and the other end of the lower-side-panel connection member 205 respectively to the connection plate 203, the side panel 120 can be detachably connected to the base 110. It should be noted that the shape and structure of the connection plate 203 may change as the shape and structure of the edge of the base 110 and the lower edge of the inner side of the side panel 120 change. Therefore, the connection plate 203 may be arranged according to actual requirement, provided that it can be connected to the other end of the base connection member 204 as well as to the other end of the lower-side-panel connection member 205. As an example, the cross section of the connection plate 203 is L-shaped, and the two edges of the L shape are connected to the base 110 and to the side panel 120, respectively, thus simplifying the structures of the base 110 and the side panel 120.

It should be noted that although the base connection member 204 and the lower-side-panel connection member 205 illustrated in FIGS. 2A-2B are both bolts, the present invention is not intended to limit the structures thereof, as long as they are able to connect to a corresponding component(s).

Preferably, the base groove 201 extends along each edge of the base 110, one end of the base connection member 204 is slidably disposed within the base groove 201 along an extending direction of the base groove 201, the lower-side-panel groove 202 extends along the lower edge of the inner side of each of the side panels 120, and one end of the lower-side-panel connection member 205 is slidably disposed within the lower-side-panel groove 202 along an extending direction of the lower-side-panel groove 202. A flexible connection is provided by arranging one end of the base connection member 204 and one end of the lower-side-panel connection member 205 such as being able to slide within the base groove 201 and within the lower-side-panel groove 202, respectively.

Figure 3A:
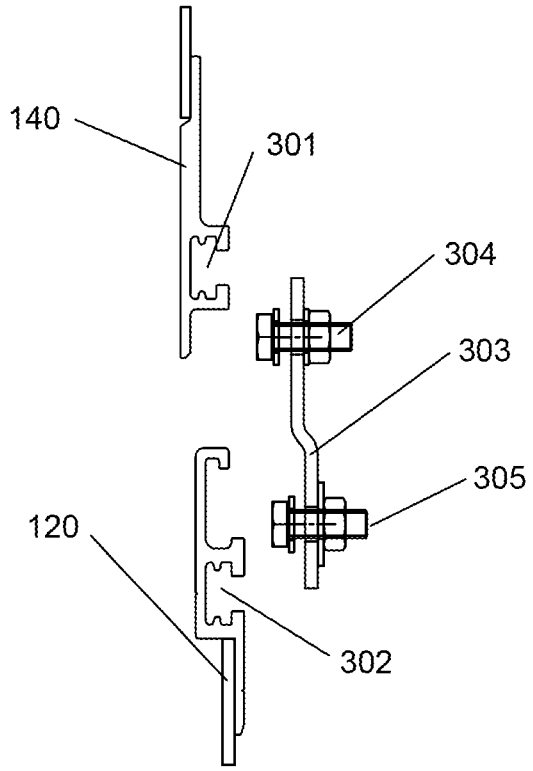
FIGS. 3A and 3B respectively illustrate schematic views of side panels and a roof panel being exploded and after assembly, according to an embodiment of the present invention.
Figure 3B:
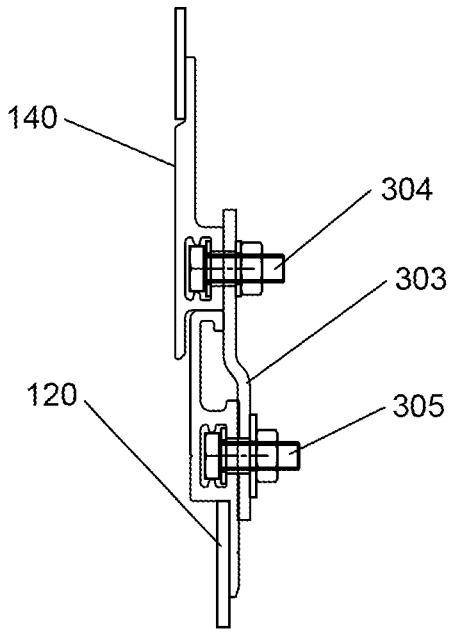

As shown in FIGS. 3A-3B, the roof panel connector comprises a roof panel groove 301, an upper-side-panel groove 302, a connection plate 303 between the roof panel and the side panels (hereinafter referred to as the connection plate 303 for short), a roof panel connection member 304, and an upper-side-panel connection member 305.

The roof panel groove 301 is located at an edge of the roof panel 140, so as for the connection between the roof panel 140 and the connection plate 303, and one end of the roof panel connection member 304 is disposed within the roof panel groove 301. The upper-side-panel groove 302 is located at an upper edge of an inner side of a side panel 120, for the connection between the side panel 120 and the connection plate 303, and one end of the upper-side-panel connection member 305 is disposed within the upper-side-panel groove 302. Since the roof panel groove 301 and the upper-side-panel groove 302 are both located inside, the outer surface of the container has no fastener protruding outwards and exposed, thus enabling the outer surface of the container to be smooth and pleasant-looking. As can be understood, roof panel grooves 301 can be arranged at edges of the roof panel 140 to be connected to the side panels 120, and accordingly, upper-side-panel grooves 302 can be arranged at the upper edges of the inner sides of the side panels 120. And, both the roof panel groove 301 and the upper-side-panel groove 302 may be in any shape and of any structure, as long as they are able to accommodate one end of the roof panel connection member 304 and one end of the upper-side-panel connection member 305, respectively. In addition, one or more connectors may be arranged at the upper edge of the inner side of each of the side panels 120 and at the corresponding position at each edge of the roof panel 140 as needed.

The other end of the roof panel connection member 304 and the other end of the upper-side-panel connection member 305 are respectively connected to the connection plate 303. By connecting the other end of the roof panel connection member 304 and the other end of the upper-side-panel connection member 305 respectively to the connection plate 303, the side panel 120 can be detachably connected to the roof panel 140. It should be noted that the shape and structure of the connection plate 303 may change as the shape and structure of the edge of the roof panel 140 and the upper edge of the inner side of the side panel 120 change. Therefore, the connection plate 303 may be arranged according to actual requirement, provided that it can be connected to the other end of the roof panel connection member 304 as well as to the other end of the upper-side-panel connection member 305. As an example, the roof panel 140 comprises a roof plate 141 and a skirt 142 (please refer to FIG. 1A), wherein the skirt 142 is arranged around the periphery of the roof plate 141 and extends downwards, the roof panel groove 301 is located on the skirt 142, and wherein the connection plate 303 is in the shape of a flat panel or in other similar shape, with the two ends of the flat panel being connected to the skirt 142 and the side panel 120, respectively. It should be noted that the flat panel is only flat as compared to the L shape, and it allows relatively small bending thereupon, as shown in FIG. 3A, as long as its two connection ends are parallel with each other.

It should be noted that although the roof panel connection member 304 and the upper-side-panel connection member 305 illustrated in FIGS. 3A-3B are both bolts, the present invention is not intended to limit the structures thereof, as long as they are able to connect to a corresponding component(s).

Preferably, the roof groove 301 extends along each edge of the roof panel 140, one end of the roof panel connection member 304 is slidably disposed within the roof panel groove 301 along an extending direction of the roof panel groove 301, the upper-side-panel groove 302 extends along the upper edge of the inner side of each of the side panels 120, and one end of the upper-side-panel connection member 305 is slidably disposed within the upper-side-panel groove 302 along an extending direction of the upper-side-panel groove 302. A flexible connection is provided by arranging one end of the roof panel connection member 304 and one end of the upper-side-panel connection member 305 such as being able to slide within the roof panel groove 301 and within the upper-side-panel groove 302, respectively.

Figure 4A:
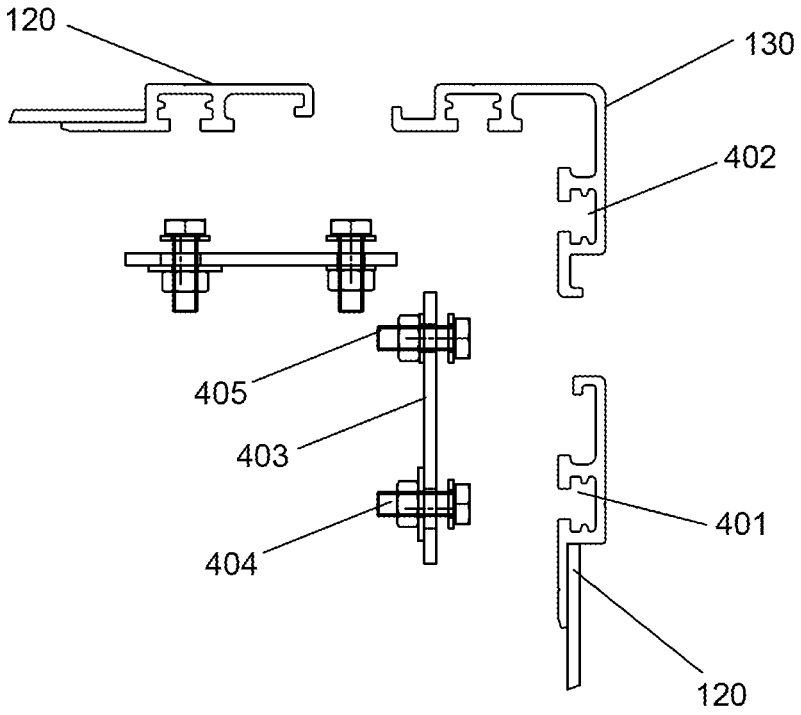
FIGS. 4A and 4B respectively illustrate schematic views of side panels and corner posts being exploded and after assembly, according to an embodiment of the present invention.
Figure 4B:
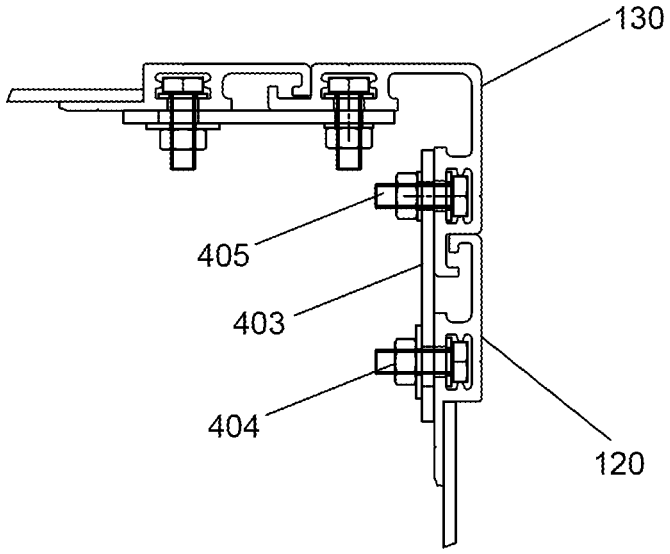

As shown in FIGS. 4A-4B, the side panel connector comprises a side panel groove 401, a corner post groove 402, a connection plate 403 between the corner posts and the side panels (hereinafter referred to as the connection plate 403 for short), a side panel connection member 404 and a corner post connection member 405. Both sides of the corner posts 130 are connected to the side panels 120. For the sake of concision, only the connector at one side will be described herein as an example to explain the present invention.

The side groove 401 is located at a side edge of an inner side of a side panel 120, so as for the connection between the side panel 120 and the connection plate 403, and one end of the side panel connection member 404 is disposed within the side panel groove 401. The corner post groove 402 is located on an inner side of a corner post 130, and one end of the corner post connection member 405 is disposed within the corner post groove 402. Since both the side panel groove 401 and the corner post groove 402 are located inside, the outer surface of the container has no fastener protruding outwards and exposed, thus enabling the outer surface of the container to be smooth and pleasant-looking. As can be understood, the side panel grooves 401 may be arranged at side edges of the inner sides of the side panels 120 to be connected to the corner posts 130, and accordingly, the corner post grooves 402 may be arranged on the inner sides of the corner posts 130. And, the side panel groove 401 and the corner post groove 402 may be in any shape and of any structure as long as they are able to accommodate one end of the side panel connection member 404 and one end of the corner post connection member 405, respectively. In addition, one or more connectors may be arranged at the side edge of the inner side of each of the side panels 120 and at the corresponding position of the inner side of each of the corner posts as needed.

The other end of the side panel connection member 404 and the other end of the corner post connection member 405 are respectively connected to the connection plate 403. By connecting the other end of the side panel connection member 404 and the other end of the corner post connection member 405 respectively to the connection plate 403, the side panels 120 can be detachably connected to the corner posts 130. It should be noted that the shape and structure of the connection plate 403 may change as the shape and structure of the side edge of the inner side of the corner posts 130 and the side panels 120 change. Therefore, the connection plate 403 may be arranged according to actual requirement, provided that it can be connected to the other end of the side panel connection member 404 as well as to the other end of the corner post connection member 405. As an example, the connection plate 403 may be in the shape of a flat panel or in any other similar shape, and the two ends of the flat panel are connected to the corner posts 130 and the side panels 120, respectively. It should be noted that the flat panel is only flat as compared to the L shape, and it allows relatively small bending thereupon, as long as the two connection ends are parallel with each other.

It should be noted that although the side panel connection member 404 and the corner post connection member 405 illustrated in FIGS. 4A-4B are both bolts, the present invention is not intended to limit the structures thereof, as long as they are able to connect to a corresponding component(s).

Preferably, the side panel groove 401 extends along the side edge of the inner side of each of the side panels 120, one end of the side panel connection member 404 is slidably disposed within the side panel groove 401 along an extending direction of the side panel groove 401, the corner post groove 402 extends along the inner side of each of the corner posts 130, and one end of the corner post connection member 405 is slidably disposed within the corner post groove 402 along an extending direction of the corner post groove 402. A flexible connection is provided by arranging one end of the side panel connection member 404 and one end of the corner post connection member 405 as being able to slide within the side panel groove 401 and within the corner post groove 402, respectively.

As described above, a detachable connection is employed for connecting the side panels with the base, the corner posts and the roof panel of the detachable container according to the present invention. Therefore, in the process of returning empty containers, each of the containers can be detached and form a whole piece, so as to reduce the space occupied. In addition, a modularized design may be employed for each component of the detachable container, so as to achieve universality of components of the container. Furthermore, this detachable container also has the advantages of convenient assembly, simple structure, etc.

The present invention has been described by virtue of the abovementioned embodiments. However, it should be appreciated that the abovementioned embodiments are exemplary and illustrative, but not intended for limiting the present invention to the embodiments described above. In addition, those skilled in the art would understand that the present invention is not limited to the abovementioned embodiments, and that more variation and modification can be made based on the teachings of the present invention, with these variations and modifications all falling within the scope of protection of the present invention. The scope of protection of the present invention is defined by the attached claims and equivalent.

What is claimed is:

1. A detachable container, comprising a base, side panels, corner posts and a roof panel, wherein the side panels are detachably connected to the base and to the roof panel, the corner posts are located between adjacent side panels and the side panels are detachably connected to the corner posts, respectively, wherein the detachable container further comprises a base connector, a roof panel connector and a side panel connector, the base connector connecting the side panels detachably to the base, the roof panel connector connecting the side panels detachably to the roof panel, and the side panel connector connecting the side panels detachably to the corner posts, and wherein the base connector includes a base groove located at edges of the base, a lower-side-panel groove located at a lower edge of an inner side of each of the side panels, a first connection plate between the base and the side panels, a base connection member, and a lower-side-panel connection member, one end of the base connection member disposed within the base groove, and one end of the lower-side-panel connection member disposed within the lower-side-panel groove, the side panels detachably connected to the base by connecting other ends of the base connection member and the lower-side-panel connection member to the connection plate between the base and the side panels, respectively.

2. The detachable container according to claim 1, wherein the roof panel comprises a roof plate and a skirt, with the skirt being arranged around a periphery of the roof plate and extending downwards, so as to form a cavity in the roof panel.

3. The detachable container according to claim 2, wherein the side panels are smaller than the roof panel such that the side panels can be accommodated within the cavity in a detached state.

4. The detachable container according to claim 3, wherein a cross section of each of the corner posts is L-shaped, with edges of the L shape being connected to adjacent side panels, respectively.

5. The detachable container according to claim 1, wherein the base groove extends along each edge of the base, the one end of the base connection member is slidably disposed within the base groove along an extending direction of the base groove, the lower-side-panel groove extends along the lower edge of the inner side of each of the side panels, and the one end of the lower-side-panel connection member is slidably disposed within the lower-side-panel groove along an extending direction of the lower-side-panel groove.

6. The detachable container according to claim 1, wherein a cross section of the first connection plate between the base and the side panels has an L-shape, with two edges of the L shape being connected to the base and the side panels, respectively.

7. A detachable container comprising a base, side panels, corner posts and a roof panel, wherein the side panels are detachably connected to the base and to the roof panel, the corner posts are located between adjacent side panels and the side panels are detachably connected to the corner posts, respectively, wherein the detachable container further comprises a base connector, a roof panel connector and a side panel connector, the base connector connecting the side panels detachably to the base, the roof panel connector connecting the side panels detachably to the roof panel, and the side panel connector connecting the side panels detachably to the corner posts, and wherein the roof panel connector comprises a roof panel groove located on each edge of the roof panel, an upper-side-panel groove located on an upper edge of an inner side of each of the side panels, first and second connection plates between the roof panel and the side panels, a roof panel connection member, and an upper-side-panel connection member, wherein one end of the roof panel connection member is disposed within the roof panel groove, and one end of the upper-side-panel connection member is disposed within the upper-side-panel groove, and wherein the side panels are detachably connected to the roof panel by connecting other ends of the roof panel connection member and the upper-side-panel connection member to the second connection plate between the roof panel and the side panels, respectively.

8. The detachable container according to claim 7, wherein the roof panel groove extends along each edge of the roof panel, the one end of the roof panel connection member is slidably disposed within the roof panel groove along an extending direction of the roof panel groove, the upper-side-panel groove extends along the upper edge of the inner side of each of the side panels, and the one end of the upper-side-panel connection member is slidably disposed within the upper-side-panel groove along an extending direction of the upper-side-panel groove.

9. The detachable container according to claim 7, wherein the roof panel comprises a roof plate and a skirt, with the skirt being arranged around a the periphery of the roof plate and extending downwards, the roof panel groove is located on the skirt, and the second connection plate between the roof panel and the side panels is in a shape of a flat panel, with two ends of the flat panel being connected to the skirt and the side panels, respectively.

10. A detachable container comprising a base, side panels, corner posts and a roof panel, wherein the side panels are detachably connected to the base and to the roof panel, the corner posts are located between adjacent side panels and the side panels are detachably connected to the corner posts, respectively, wherein the detachable container further comprises a base connector, a roof panel connector and a side panel connector, the base connector connecting the side panels detachably to the base, the roof panel connector connecting the side panels detachably to the roof panel, and the side panel connector connecting the side panels detachably to the corner posts, and wherein the side panel connector comprises a side panel groove located at a side edge of an inner side of each of the side panels, a corner post groove located at an inner side of each of the corner posts, first, second and third connection plates between the corner posts and the side panels, a side panel connection member, and a corner post connection member, wherein one end of the side panel connection member is disposed within the side panel groove, and one end of the corner post connection member is disposed within the corner post groove, and wherein the side panels are detachably connected to the corner posts by connecting the other ends of the side panel connection member and the corner post connection member to the third connection plate between the corner posts and the side panels, respectively.

11. The detachable container according to claim 10, wherein the side panel groove extends along the side edge of the inner side of each of the side panels, the one end of the side panel connection member is slidably disposed within the side panel groove along an extending direction of the side panel groove, the corner post groove extends along the inner side of each of the corner posts, and the one end of the corner post connection member is slidably disposed within the corner post groove along an extending direction of the corner post groove.

12. The detachable container according to claim 10, wherein the third connection plate between the corner posts and the side panels is in a shape of a flat panel, with two ends of the flat panel being connected to the corner posts and the side panels, respectively.

* * * * *